US005932970A

United States Patent [19]

Chiba et al.

[11] Patent Number: 5,932,970

[45] Date of Patent: Aug. 3, 1999

[54] PREFORM FOR FLUORESCENT LAMP, FLUORESCENT LAMP PREPARED BY THE SAME, AND METHOD FOR PREPARING THE FLUORESCENT LAMP

[75] Inventors: Masatosi Chiba; Ryuichi Suzuki; Akihiko Tsurumaru; Koji Kikuchihara, all of Fukushima-ken, Japan

[73] Assignee: Stanley Electric Co., Ltd., Tokyo, Japan

[21] Appl. No.: 08/943,745

[22] Filed: Oct. 3, 1997

[30] Foreign Application Priority Data

Oct. 25, 1996 [JP] Japan ..... 8-283923

[51] Int. Cl.[6] ..... H01J 17/18

[52] U.S. Cl. ..... 313/623; 313/625; 445/26

[58] Field of Search ..... 313/493, 623, 313/625, 580, 318.09; 445/26

[56] References Cited

U.S. PATENT DOCUMENTS

| | | | |
|---|---|---|---|
| 4,866,341 | 9/1989 | Ichiga et al. | 313/623 |
| 5,176,558 | 1/1993 | Newell | 445/26 |
| 5,432,403 | 7/1995 | Shaffer | 313/619 |

FOREIGN PATENT DOCUMENTS

| | | | |
|---|---|---|---|
| 0 076 503 A2 | 4/1982 | European Pat. Off. | H02J 61/34 |
| 57-111931 | 12/1982 | Japan | H01J 9/395 |
| 58-108634 | 6/1983 | Japan | H01J 9/34 |
| 443963 | 10/1992 | Japan . | |
| 443964 | 10/1992 | Japan . | |
| 08064137 | 8/1996 | Japan | H01J 9/385 |

*Primary Examiner*—Sandra O'Shea
*Assistant Examiner*—Todd Reed Hopper
*Attorney, Agent, or Firm*—Weingarten, Schurgin, Gagnebin & Hayes LLP

[57] ABSTRACT

There is provided a preform for a fluorescent lamp comprising a bulb and a stem provided with a filament and a discharge electrode and a fluorescent lamp prepared by the preform without an exhaust pipe for use as an indicating lamp, the fluorescent lamp being sealed after exhausting inside air and charging inert gas and mercury through an appropriate space formed between the bulb and the stem inserted into the bulb. Thus, even when liquefied mercury is present in the discharge chamber, it receives a large amount of heat from the filament applied voltage and is easily and quickly evaporated, whereby the characteristics of the lamp become stable quickly after turning on the lamp.

6 Claims, 2 Drawing Sheets

PREFORM FOR FLUORESCENT LAMP, FLUORESCENT LAMP PREPARED BY THE SAME, AND METHOD FOR PREPARING THE FLUORESCENT LAMP

BACKGROUND OF THE INVENTION

1. Field of the Invention

This invention relates to a preform for a fluorescent lamp for use as an indicating lamp so-called a single-end type fluorescent lamp, a fluorescent lamp prepared by the preform and a method for preparing the fluorescent lamp, particularly to a single-end type fluorescent lamp provided with a feeder unit at one end portion of a bulb to be suitable for use as an indicating lamp for an apparatus or a light emission element for an electric sign board.

2. Background Art

FIG. 4 shows the configuration of this type of a fluorescent lamp 90 for use as an indicating lamp of the prior art which is constructed by welding a bulb 91 whose inner surface is coated with a fluorescent material 92 to a stem 96 provided with a filament 93 coated with an electron emission substance 93*a*, a discharge electrode 94, and an exhaust pipe 95 in advance and exhausting inside air from the exhaust pipe 95, charging an inert gas 97 and mercury 98 into the bulb 92 and heat sealing this exhaust pipe 95 to seal the fluorescent lamp 90.

However, in the fluorescent lamp 90 for use as an indicating lamp of the prior art, since the sealing of the fluorescent lamp is achieved by heat-sealing the exhaust pipe 95, it is inevitable in the process that the exhaust pipe 95 projects from the stem 96. As the exhaust pipe 95 projecting from the stem 96 is easily cooled from the outside, the mercury 98 charged in the lamp tends to be liquefied in the exhaust pipe 95 having a lower temperature and to stay therein in a liquid state.

When the filament 93 is applied voltage to turn on the fluorescent lamp 90 for use as an indicating lamp, it takes a long time for the heat of the filament 93 to reach the mercury 98 in the exhaust pipe 95 located farther than the stem 96 from the filament and evaporate the mercury 98 thereby. As a result, a long time is required from the start of lighting until the characteristics of the lamp becomes stable.

In addition, since the exhaust pipe 95 projects, when an indicating unit, for example, is formed by mounting the fluorescent lamp 90 for use as an indicating lamp on a substrate, the exhaust pipe 95 may be broken by contacting it to the substrate and the fluorescent lamp 90 for use as an indicating lamp itself may be broken. Thus, a handling problem may occur.

SUMMARY OF THE INVENTION

An object of the present invention as means for solving the problems of the prior art is to provide a preform for a fluorescent lamp, in which the preform comprises a bulb having a bulb body portion which forms a bulb body of the fluorescent lamp and an exhausting pipe portion through which inside air is exhausted and inert gas and mercury is charged, an inner surface of the bulb body portion being coated with a fluorescent material, and a stem provided with a filament coated with an electron emission substance and a discharge electrode, in which the stem is inserted into the bulb to set a predetermined position, and the inner diameter of the bulb is made larger than the outer diameter of the stem so as to form a space therebetween for enabling inside air to be exhausted from the inside of the bulb and inert gas and mercury to be charged into the inside of the bulb therethrough.

Another object of the present invention is to provide a preform for a fluorescent lamp as above, in which the bulb further comprises a projection formed on an inner surface of the bulb so as to set the inserted stem at the predetermined position.

Still another object of the present invention is to provide a fluorescent lamp for use as an indicating lamp, in which the fluorescent lamp is prepared by the preform as above.

Furthermore, another object of the present invention is to provide a method for preparing a fluorescent lamp for use as an indicating lamp, the method comprising the steps of:

providing a stem with a filament coated with an electron emission substance and a discharge electrode;

providing a bulb having a bulb body portion which forms a bulb body of the fluorescent lamp and an exhausting pipe portion through which inside air is exhausted and inert gas is charged, the inner diameter of the bulb being made larger than the outer diameter of the stem so as to form a space therebetween for enabling inside air to be exhausted from the inside of the bulb and inert gas and mercury to be charged into the inside of the bulb therethrough;

inserting the stem into the bulb to a predetermined position so as to prepare a preform of the fluorescent lamp;

connecting the end of the exhausting pipe portion to an exhausting machine;

exhausting air inside the bulb and charging inert gas and mercury into the bulb through the space between the stem and the bulb by the exhausting machine;

welding the bulb to the stem by heating it from the outside of the bulb; and removing the exhausting pipe portion of the bulb.

A still further object of the present invention is to provide a method for preparing a fluorescent lamp for use as an indicating lamp as above, in which the bulb further comprises a projection formed on an inner surface of the bulb so as to set the inserted stem at the predetermined position.

BRIEF DESCRIPTION OF THE DRAWINGS

These objects and advantages of the present invention will become clear from the following description with reference to the accompanying drawings, wherein.

DETAILED DESCRIPTION OF THE PREFERRED EMBODIMENTS

Figure 1:
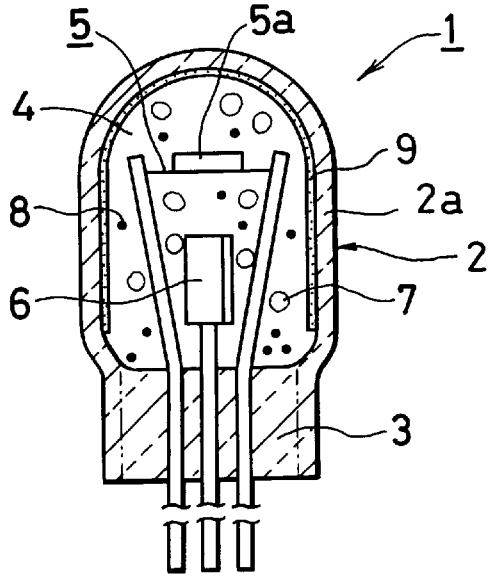
FIG. 1 is a sectional view of a fluorescent lamp for use as an indicating lamp according to an embodiment of the present invention.

The present invention is described in detail with reference to an embodiment shown in the accompanying drawings. In FIG. 1, reference numeral 1 denotes a fluorescent lamp for use as an indicating lamp according to the present invention (to be simply referred to as "fluorescent lamp 1" hereinafter). The fluorescent lamp 1 is of a single-end type fluorescent lamp comprising a bulb 2 whose inner surface is coated with a fluorescent material 9, and a stem 3 provided with a filament 5 coated with an electron emission substance 5*a*, and a discharge electrode 6 so as to form a discharge chamber 4 by welding the bulb 2 to the stem 3 like the prior art.

An inert gas 7 such as argon, neon, krypton or xenon and an appropriate amount of mercury 8 are charged into the discharge chamber 4 like the prior art. However, in the present invention, no exhaust pipe is provided in the stem 3.

Figure 2:
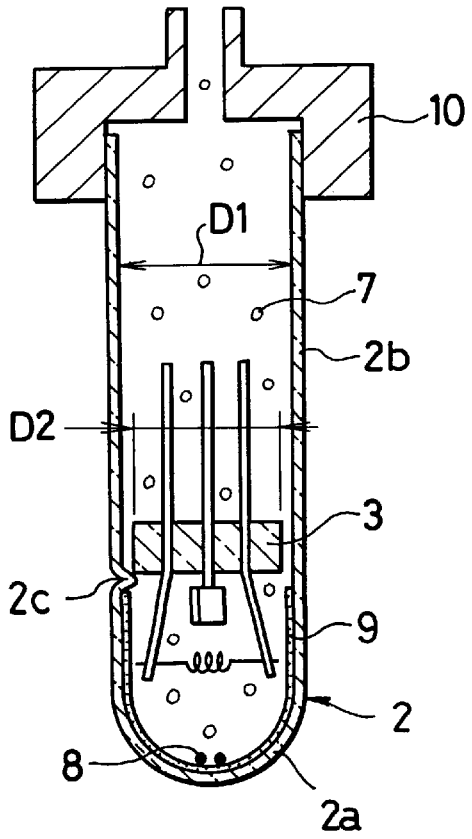
FIG. 2 is a diagram for explaining the exhaust process of the fluorescent lamp for use as an indicating lamp according to the present invention.
Figure 3:
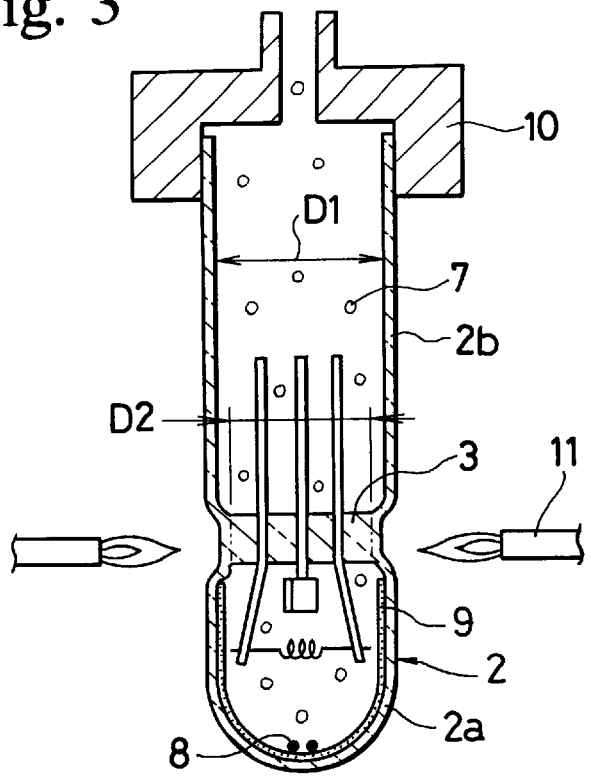
FIG. 3 is a diagram for explaining a sealing process according to the present invention.
Figure 4:
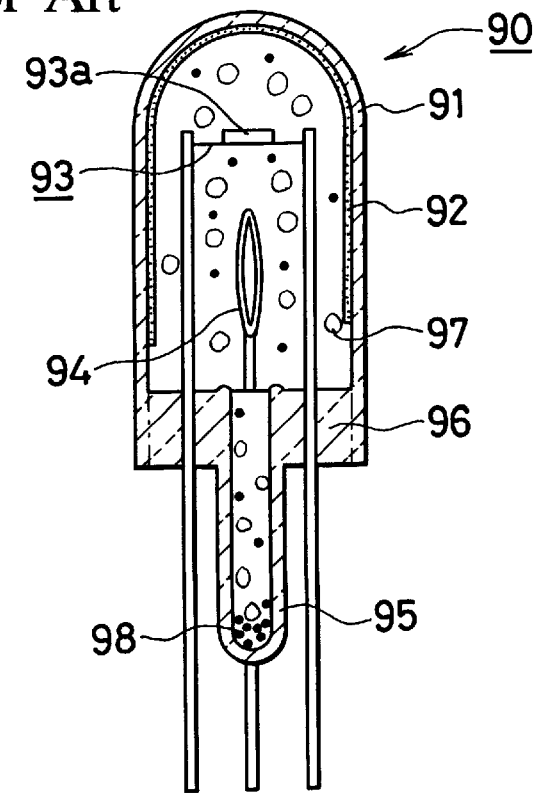
Fig. 4 Prior Art
FIG. 4 is a sectional view of a fluorescent lamp according to the prior art.

FIG. 2 and FIG. 3 show an example of the production process of the fluorescent lamp 1 of the present invention configured as described above. A preform of the fluorescent lamp 1 comprises the bulb 2 having a bulb portion 2*a* which forms a bulb body of the fluorescent lamp 1 and is coated with the fluorescent material 9 and an exhausting pipe portion 2*b* through which inside air is exhausted and inert gas and mercury are charged, and the stem inserted into the bulb 2.

In the present invention, the inner diameter D1 of the bulb 2 is suitably made larger than the outer diameter D2 of the stem 3 and there is an appropriate space therebetween when the stem 3 is inserted into the bulb 2.

The bulb 2 of the preform has an appropriate length so that the exhausting pipe portion 2*b* can be directly connected to an exhaust head 10 of an exhausting machine for exhausting inside air and charging inert gas and mercury thereinto (not shown) while the stem 3 is inserted in the bulb 2. Further a projection 2*c* is formed on the inner surface of the bulb 2 so that the stem 3 is set at a predetermined position when the stem 3 is inserted into the bulb 2.

The bulb 2 formed as described above is connected to the exhaust head 10 while the stem 3 is inserted in the bulb 2 as shown in FIG. 2. Therefore, the stem 3 is contacted to the projection 2*c* by its weight and can be positioned at a predetermined location in the bulb 2. When the air inside the bulb 2 is exhausted by the exhaust head 10 in this state, air in the bulb portion 2*a* the inside of which becomes the discharge chamber 4 after sealing is exhausted through the above space between the bulb 2 and the stem 3 and the inside of the bulb 2 becomes a vacuum.

When the inert gas 7 and the mercury 8 are then supplied into the bulb 2, the inert gas 7 is spread into the bulb portion 2*a* of the bulb 2 which becomes the discharge chamber 4 through the space and the mercury 8 having a high specific gravity collects in a lower end portion of the bulb 2 in this state through the space as shown in FIG. 2.

Thereafter, as shown in FIG. 3, a location where the stem 3 is positioned is heated by a burner 11 from the outside of the bulb 2 to weld the bulb 2 to the stem 3 and an unrequired portion of the bulb 2, i.e. the exhausting pipe portion 2*b* is removed thereby, the fluorescent lamp 1 without an exhaust pipe, which the present invention is directed to, can be obtained.

A description is subsequently given of the function and effect of the fluorescent lamp 1 of the present invention configured as described above. Since any exhaust pipe in the stem is not present in the present invention, even when the mercury 8 is liquefied by the lowering of an ambient temperature while the fluorescent lamp 1 is off, the liquefied mercury 8 is present in the discharge chamber 4, that is, at a location near the filament 5. Therefore, when the filament 5 is applied voltage to turn on the fluorescent lamp 1, the mercury 8 receives a large amount of heat from the filament 5 and is evaporated quickly, whereby the characteristics of the fluorescent lamp 1 become stable in a short period of time after turning on the lamp.

Since there is no exhaust pipe projecting from the stem 3 after being finished, when a plurality of fluorescent lamps 1 are mounted on a substrate to fabricate an indicating panel, the mounting operation can be made without paying attention not to break an exhaust pipe. Further, it is possible to arrange the fluorescent lamp 1 in close contact with the substrate, thereby improving variation for mounting and arranging the fluorescent lamp on a substrate.

As described above, according to the present invention, since a fluorescent lamp for use as an indicating lamp is constructed without any exhaust pipe, liquefied mercury is present in the discharge chamber near the filament and thus easily receives a large amount of heat from the filament at the time of turning on the lamp. Therefore, the liquefied mercury is evaporated quickly, whereby the characteristics of the lamp become stable quickly after turning on the lamp. Thus, the present invention provides an extremely excellent effect that the performance of the fluorescent lamp for use as an indicating lamp is improved.

In addition, since there is no exhaust pipe projecting from the stem, when an indicating panel is fabricated by mounting a plurality of the fluorescent lamps according to the present invention, the mounting operation can be carried out without paying attention not to break the exhaust pipe. Therefore, the present invention provides an effect that handling operation is simplified. Further, it is possible to arrange the fluorescent lamp for use as an indicating lamp in close contact with the substrate due to the absence of the exhaust pipe. Therefore, the present invention provides an excellent effect that variation for mounting and arranging the fluorescent lamps on a substrate is improved to reduce the size of the indicating panel.

While the presently preferred embodiment of the present invention has been shown and described, it will be understood that the present invention is not limited thereto, and that various changes and modifications may be made by those skilled in the art without departing from the scope of the invention as set forth in the appended claims.

What is claimed is:

1. A preform for a fluorescent lamp, said preform comprising a bulb having a bulb body portion which forms a bulb body of the fluorescent lamp and an exhausting pipe portion through which inside air is exhausted and inert gas and mercury are charged, an inner surface of the bulb body portion being coated with a fluorescent material, and a stem provided with a filament coated with an electron emission substance and a discharge electrode, said stem being inserted into said bulb to set a predetermined position, wherein the inner diameter of the bulb is made larger than the outer diameter of the stem so as to form a space therebetween for enabling inside air to be exhausted from the inside of the bulb and inert gas and mercury to be charged into the inside of the bulb therethrough.

2. The preform for a fluorescent lamp according to claim 1, wherein said bulb further comprises a projection formed on an inner surface of the bulb so as to set the inserted stem at the predetermined position.

3. A fluorescent lamp for use as an indicating lamp, wherein said fluorescent lamp is prepared by the preform according to claim 1.

4. A method for preparing a fluorescent lamp for use as an indicating lamp, said method comprising the steps of:

providing a stem with a filament coated with an electron emission substance and a discharge electrode;

providing a bulb having a bulb body portion which forms a bulb body of the fluorescent lamp and an exhausting pipe portion through which inside air is exhausted and inert gas and mercury are charged, the inner diameter of the bulb being made larger than the outer diameter of the stem so as to form a space therebetween for enabling inside air to be exhausted from the inside of the bulb and inert gas and mercury to be charged into the inside of the bulb therethrough;

inserting the stem into the bulb to a predetermined position so as to prepare a preform of the fluorescent lamp;

connecting the end of the exhausting pipe portion to an exhausting machine;

exhausting air inside the bulb and charging inert gas and mercury into the bulb through the space between the stem and the bulb by the exhausting machine;

welding the bulb to the stem by heating it from the outside of the bulb; and removing the exhausting pipe portion of the bulb.

5. The method for preparing a fluorescent lamp for use as an indicating lamp according to claim 4, wherein said bulb further comprises a projection formed on an inner surface of the bulb so as to set the inserted stem at the predetermined position.

6. A fluorescent lamp for use as an indicating lamp, wherein said fluorescent lamp is prepared by the preform according to claim 2.

* * * * *